US005768672A

United States Patent [19]

van Herpen et al.

[11] Patent Number: 5,768,672

[45] Date of Patent: Jun. 16, 1998

[54] CLEANING MEMBERS OF IMAGE RECORDING DEVICES

[75] Inventors: Wilhelmus Martinus van Herpen, Velden; Edwin Maria Hubertus Kuypers, Ittervoort; Peter Richard Markies, Grubbenvorst; Jozef Paulus Moonen, Brunssum; Hendrik Jan Stolk, Bergen; Julius Vibringa Cornelis Graswinckel, Arcen, all of Netherlands

[73] Assignee: OCE-Technologies B.V., Venlo, Netherlands

[21] Appl. No.: 855,365

[22] Filed: May 13, 1997

[30] Foreign Application Priority Data

May 13, 1996 [NL] Netherlands ..... 1003092

[51] Int. Cl.[6] ..... G03G 15/16; G03G 15/20

[52] U.S. Cl. ..... 399/327; 399/101

[58] Field of Search ..... 399/327, 99, 100, 399/101, 350, 352, 357; 15/256.5, 256.51, 256.52; 134/6, 9

[56] References Cited

U.S. PATENT DOCUMENTS

| | | | |
|---|---|---|---|
| 3,762,950 | 10/1973 | Royka | 134/6 |
| 4,000,963 | 1/1977 | Thettu . | |
| 4,013,400 | 3/1977 | Thettu et al. . | |
| 4,200,389 | 4/1980 | Matsui et al. . | |
| 4,588,279 | 5/1986 | Fukuchi et al. . | |

FOREIGN PATENT DOCUMENTS

| | | |
|---|---|---|
| 0149860 | 7/1985 | European Pat. Off. . |
| 0203640 | 12/1986 | European Pat. Off. . |
| 0212685 | 3/1987 | European Pat. Off. . |
| 0581355 | 2/1994 | European Pat. Off. . |
| 3225836 | 2/1983 | Germany . |
| 3338989 | 5/1984 | Germany . |
| 2104841 | 3/1983 | United Kingdom . |

*Primary Examiner*—Joan H. Pendegrass

*Attorney, Agent, or Firm*—Birch, Stewart, Kolasch & Birch, LLP

[57] ABSTRACT

A cleaning member for cleaning a surface which, for example in an image recording device, is brought into contact with toner powder or an image receiving material carrying toner powder. The cleaning member comprises a surface layer of a high-viscosity polymeric material that is sticky at room temperature. Preferably, the polymeric material is a polymer or polymeric mixture having a viscosity between $10^4$ and $10^6$ Pa.s at 20° C., and a very suitable polymer is polyisobutylene, having a molecular mass of about 100,000.

The cleaning member is preferably provided with mixing means for mixing into the mass of the sticky layer impurities that are deposited on the surface thereof.

13 Claims, 1 Drawing Sheet

CLEANING MEMBERS OF IMAGE RECORDING DEVICES

FIELD OF THE INVENTION

The invention relates to a cleaning member for cleaning a surface which, for example in an image recording device, is brought into contact with toner powder or receiving material carrying a toner powder, which cleaning member comprises a carrier provided with a sticky surface layer which removes impurities from the surface. The invention also relates to an image recording device equipped with such a cleaning member.

BACKGROUND OF THE INVENTION

A cleaning member of the above type is used in an image recording device more particularly for removing impurities, such as paper dust and toner powder residues, from a fixing surface of the thermal contact fixing device, in which a toner powder image is fixed or transferred and fixed on a receiving paper or other receiving material. Where necessary, a cleaning member of this kind can also be used in transport means which feed a print back to an image transfer station so that the reverse side can also be provided with an image, or which discharge to a collecting station a completed fixed print.

A cleaning member as described above is known from U.S. Pat. Nos. 4,000,963 and 4,013,400. Both specifications describe a cleaning member constructed as a rotatable roller which moves over the fixing surface for cleaning and is provided with a surface layer of polymeric material which is sticky at the operating temperature of the fixing device. The cleaning member is also provided with means for renewing the sticky surface layer as soon as its cleaning effect is exhausted.

A similar cleaning device is described in European Patent No. 0 203 640, in which the time when the sticky layer on the cleaning member requires renewal is determined by means of light reflection measurement at the surface of the cleaning member. In this case the sticky material preferably consists of a layer of toner powder of the same type as that with which the toner powder images for fixing are formed. The layer of toner powder is heated to adhesion temperature by a heating element. One disadvantage of the cleaning device described above is that the cleaning action of the sticky layers described is relatively restricted and the time when renewal of the layer is necessary is reached all too quickly. Depending on whether the image receiving paper used yields more or less dust to the fixing surface, renewal of the sticky layer appears necessary for every 2,000 to 5,000 copies of WP format. The result of frequent application of a fresh layer of sticky material is that the maximum admissible layer thickness is reached relatively quickly and the cleaning member itself has to be replaced relatively frequently. The cleaning member life can be lengthened by using a hollow cleaning roller, the surface of which is provided with holes or slots through which spent sticky material can be stored in the cleaning roller itself. Cleaning rollers of this kind are described, for example, in European Patent No. 0 149 860. A disadvantage of this is that the cleaning member does not have any cleaning action on the fixing surface at the location of the holes or slots. Other disadvantages of the prior art cleaning devices are that the temperature range within which a good cleaning action is achieved is relatively small, so that in addition to a heating element for heating the sticky material, temperature measurement and control is necessary to operate the device in the optimum working range. Also, particularly when toner material is used, the sticky material can harden so that there is a risk of damage to the fixing surface. Other disadvantages are high energy consumption and the need to provide means for renewing the layer of sticky material at the correct times.

SUMMARY OF THE INVENTION

The invention provides an improved cleaning member for cleaning a surface which, for example in an image recording device, is brought into contact with toner powder or a receiving material having a toner powder image, said cleaning member being provided with a sticky surface layer that removes impurities from the surface, wherein the sticky surface layer comprises a high-viscosity polymeric material which is sticky at room temperature. The cleaning member according to the invention differs from the cleaning members according to the prior art by a long life and a wide working temperature range. One particular advantage of the invention is that no heating element or temperature control is required to bring and/or keep the cleaning member at the required operating temperature.

BRIEF DESCRIPTION OF THE DRAWINGS

The invention will now be explained in detail with reference to the accompanying drawings wherein.

DETAILED DESCRIPTION OF THE INVENTION

In its simplest embodiment, the cleaning member according to the invention consists of a carrier in the form of a roller, e.g., of aluminum or other metal, glass or plastic, to which an approximately 1–5 mm thick layer of high-viscosity polymer sticky at room temperature is applied. The sticky material is preferably a polymer, or mixture of polymers having a viscosity between $10^4$ and $10^6$ Pa's at room temperature (20° C). A very suitable polymer is polyisobutylene, particularly polyisobutylene having a molecular mass of about 100,000. Other suitable materials are copolymers of ethylene with propylene and, if required, diene (EPM and EPDM rubbers) and also the silicon gums. To prevent the layer of polymeric material from dripping out it can also contain an agent which introduces a liquid limit. Agents of this kind are, for example, fillers such as silica, titanium dioxide, zinc oxide, etc. The amount of filler is on the one hand such that the layer will not obstructively drip out when the cleaning member is in the operative state and stationary, and on the other hand not such that the adhesive power is reduced excessively as a result. An optimum quantity of filler can be determined relatively easily by experiment and is usually 8 to 12% by weight.

The cleaning effect and particularly the life of the cleaning member according to the invention can be readily increased if the impurities, such as paper dust and toner material, which are removed by the surface of the sticky layer from the fixing surface or other surface for cleaning, are mixed over the volume of the sticky layer by a mixing means.

The mixing means can easily consist of a spatula penetrating into the layer of sticky material to a depth of 50 to 100 micrometers or even deeper, and, when the cleaning member is in operation, being made to reciprocate axially between the two ends of the layer. As a result of this movement, the impurities deposited on the surface of the sticky layer are mixed with the bulk thereof. In this way, without renewing the layer of sticky material, and even when "high-dust-content" paper is used, a life of 100,000 prints of A4 format for the cleaning member is achieved with a sticky material layer thickness of 2.5 to 3.5 mm.

Figure 1:
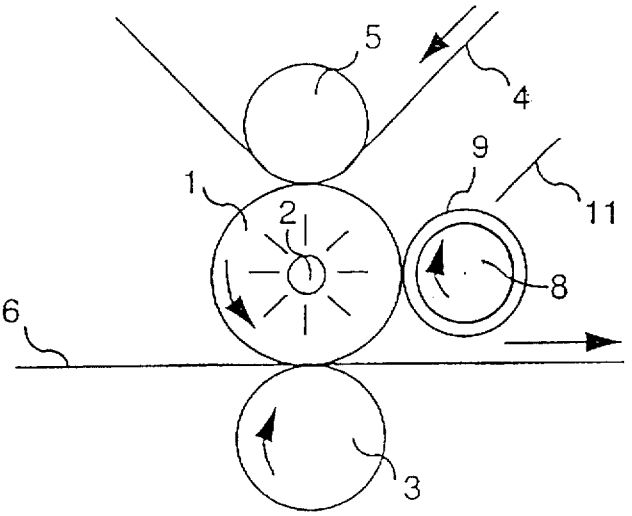
FIG. 1 is a diagrammatic cross-section of a transfer/fixing device provided with a cleaning member according to the invention.

The transfer/fixing device shown in FIG. 1 comprises a fixing roller 1 heated by an internal heating element 2 and coated with a layer of silicone rubber. A biasing roller 3, which is also covered with silicone rubber, presses against the fixing roller 1. A photoconductive belt 4 is brought into pressure contact with the fixing roller 1 by means of a biasing roller 5. A toner powder image formed on the photoconductive belt 4 in known manner is transferred to the fixing roller 1 as a result of the pressure contact. The toner powder softens on the heated fixing roller 1 and the softened material is transferred to a sheet of receiving paper 6 in the nip between the fixing roller 1 and the biasing roller 3, with simultaneous fixing, the sheet of receiving paper being fed to the nip by transport means (not shown) and heatable during transport to the nip.

Figure 2:
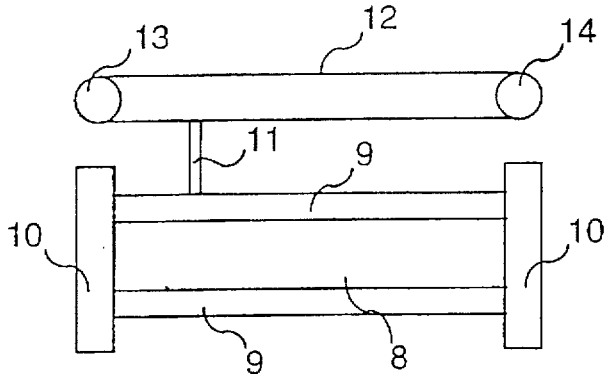
FIG. 2 is a diagrammatic longitudinal section of a cleaning member and a mixing element co-operating therewith.

On the side where the surface of the roller moves towards the photoconductive belt 4, a cleaning member is pressed against the fixing roller 1, said cleaning member consisting of a freely rotatable metal roller 8, the surface of which is covered with a layer of polyisobutylene. In this embodiment, roller 8 consists of aluminum and has a diameter of 65 mm. The choice of material for the roller 8 and its diameter are not critical. However, it will be clear that as the diameter of the roller 8 increases, the capacity of the cleaning roller and hence its life increases. The layer of polyisobutylene has a thickness of about 3 mm and consists of polyisobutylene having an average molecular mass (weight averaged) of about 100,000. Suitable polyisobutylene can be obtained, inter alia, under the trade name OPPANOL B15 from BASF, Germany and VISTANEX from Exxon Chemicals, USA. Approximately 9% by weight of silica is added to the polyisobutylene in order to bring its liquid limit to a level such that the sticky layer 9 on the roller 8 does not drip off. To prevent the highly viscous layer 9 from flowing away at the ends of the roller 8, an upright collar 10 is provided at both ends of roller 8, as shown in FIG. 2. The collars 10 are of course outside the axial part of the layer 9 in contact with the fixing roller 1. They consist, for example, of polyurethane foam and have a width of 15 mm and a thickness of 14 mm.

A spatula 11 made of hard material, such as metal or hard plastic, penetrates the sticky layer to a depth of about 0.75 mm. In the embodiment illustrated, the spatula has a width of about 20 mm and a thickness of 0.5 mm. When the cleaning device is in operation, the spatula 11 is moved in reciprocation between the collars 10 at a speed of 40 to 50 mm per second by known means, e.g., a chain or cord 12 trained over guide rollers 13 and 14, and drive means (not shown in detail). In so doing, the reciprocating spatula 11 ensures that the impurities, e.g., paper dust and toner residues, removed from the fixing roller 1 are thoroughly mixed with the bulk of the sticky layer 9.

The cleaning member as described above gives very good cleaning of the fixing roller 1 in the long term. When a relatively high dust content receiving paper is used, good operation of the cleaning roller 8 was found after some 100,000 copies of A4 format. It was also found that there was practically no deposition, or hardly any deposition, of polyisobutylene via the fixing roller 1 on the photoconductive belt 4.

Although the embodiment of the invention described in connection with FIGS. 1 and 2 comprises the cleaning roller 8 always in contact with the fixing roller 1, it will be clear that the device can also be so constructed that the rollers 8 and 1 are released when no prints are required to be fixed. The effect of this is that if the device has been out of operation for a long period the cleaning roller 8 will not stick to the fixing roller 1 and thus cause damage to the fixing surface when the device is re-started. The spatula 11 is also preferably withdrawn from the sticky layer 9 when the device is inoperative.

Instead of a spatula 11, other mixing mechanisms can be used for mixing the impurities in the sticky layer 9. According to a first variant, a woven stocking is applied to the sticky layer 9, the fabric yarns having a thickness of about 0.5 to 1 mm and the mesh width being about 10×10 mm. Deformation and elongation phenomena take place locally in the fabric as a result of the pressure loading in the nip between the fixing roller and the cleaning roller 8. As a result, the woven stocking will rotate slowly and will move with respect to the surface of the roller 8. The sticky layer follows this movement only partly, resulting in a mixing of the impurities in the sticky layer.

According to a variant of the embodiment described above, a metal sleeve of a diameter somewhat larger (e.g., 1 mm) than the diameter of roller 8 is enclosed in the sticky layer, instead of a woven stocking. The sleeve is provided with a large number of apertures all round, each having an area of 50 to 100 $mm^2$ and of a substantially arbitrary shape. As a result of the loading in the nip between the cleaning roller and the fixing roller, the sleeve is locally pressed in the direction of the surface of the cleaning roller. The differences in the diameters of the roller and the sleeve result in a difference in the revolution times, so that the sleeve rotates with respect to the roller. The sticky layer does not follow this movement and is mixed.

According to yet another variant, the sticky layer 9 is mixed with hard spherical particles having a diameter of about 0.5 mm. The particles are, for example, glass beads or metal balls. On the passage through the nip between the cleaning roller and the fixing roller, differences occur in speed between the spherical particles and the elastic sticky layer. The spherical particles thus move through the sticky layer, resulting in a mixing in the layer.

Finally, mixing of the impurities with the bulk of the sticky layer can also be obtained by replacing the reciprocating spatula 11 by a stationary comb or closed plate extending over the entire axial length of the cleaning roller 8 and penetrating into the sticky layer to a depth of 0.15–1 mm for example.

Other possible variants of the invention will be clear to those skilled in the art. For example it will be clear that a cleaning belt trained over two or more guide rollers can be used instead of a cleaning roller 8.

Figure 3:
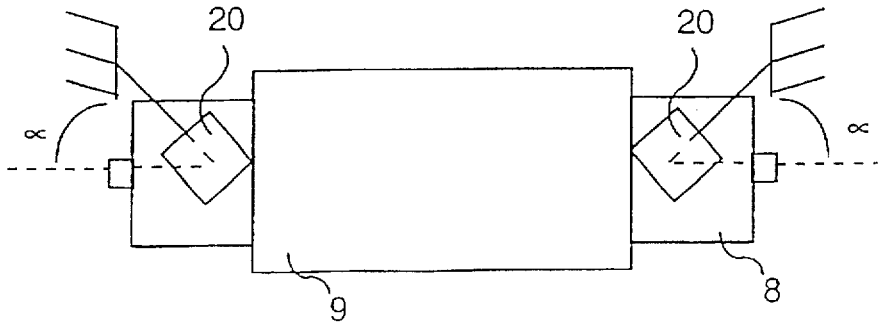
FIG. 3 is a diagrammatic longitudinal section of a cleaning member and small rollers co-operating therewith.

Instead of the upright collars 10, preventing the highly viscous layer 9 from flowing away at the ends of the roller 8, a small roller 20 of silicon gum rubber or having a surface coating of silicon gum rubber or other material which is adhesive for the tacky material of layer 9, may be provided at each end of roller 8, as shown in FIG. 3. The rollers 20 are slanted with respect to the roller 8.

The axis of rotation of each of the rollers 20 crosses the axis of rotation of roller 8 under edge $\alpha$ which preferably amounts between 5° and 20°, and typically is about 8°0.

The slanted position of the rollers 20 with respect to roller 8 results upon rotation of the rollers 8 and 20 in an inwardly directed force, acting on the viscous layer 9 and thus preventing the viscous material from flowing towards the end of the roller 8. The rollers 20 contact the surface of roller 8 under light pressure, so that the rollers 20 are driven by roller 8. Alternately, rollers 20 are disposed at a slight distance from the roller 8, the gap between each of the rollers 20 and roller 8 being considerably less than the thickness of the viscous layer 9. Viscous material of layer 8 will penetrate this gap and ensure that rollers 20 will be driven by rotation of roller 8, thus creating the inwardly directed force preventing the viscous material from flowing further to the ends of roller 8.

The invention being thus described, it will be obvious that the same may be varied in many ways without departing from the spirit and scope of the invention. All such modifications are intended to be included within the scope of the following claims.

We claim:

1. A cleaning member of an image recording device for cleaning a surface that is brought into contact with toner powder or a receiving material having a toner powder image, the cleaning member comprising:

a carrier having coated thereon a surface layer of a high-viscosity polymeric material that is sticky at room temperature.

2. The cleaning member according to claim 1, wherein the sticky polymeric material has a viscosity between $10^4$ and $10^6$ Pa'S at 20° C.

3. The cleaning member according to claim 2, wherein the sticky polymeric material comprises polyisobutylene or a copolymer of ethylene with propylene, and optionally a diene or a silicone gum.

4. The cleaning member according to claim 3, wherein the sticky material comprises polyisobutylene.

5. The cleaning member according to claim 4, wherein the sticky layer contains a filler.

6. An apparatus for fixing or transferring and fixing powder image onto an image receiving material under the influence of pressure and heat, comprising:

co-operating fixing members which form a pressure zone wherein a toner powder image is pressed against the image receiving material, heating means for heating at least one of the fixing members, a cleaning member for cleaning the fixing surface of the fixing member brought into contact with the toner powder image, and said cleaning member containing a sticky surface layer which is brought into contact with the said fixing surface, and wherein the sticky surface layer comprises a high viscosity polymeric material.

7. The apparatus according to claim 6, wherein the cleaning member contains means for mixing into the mass of the sticky layer impurities that are deposited thereon.

8. The apparatus according to claim 7, wherein the mixing means comprises a spatula, which is movable through the sticky layer.

9. The apparatus according to claim 7, wherein the mixing means comprises an apertured carrier that is contained within the sticky layer.

10. The apparatus according to claim 7, wherein the mixing means comprises hard spherical particles having a diameter of about 0.5 mm that are contained within the sticky layer.

11. The apparatus according to claim 6, wherein said cleaning member comprises a rotatable roller carrying on its circumferential surface said sticky surface layer.

12. The apparatus according to claim 11, wherein means are provided for preventing the material of said sticky surface layer from flowing towards the ends of said roller.

13. The apparatus according to claim 12, wherein said means comprise a roller the circumferential surface of which is slanted with respect to the circumferential surface of said roller carrying said sticky surface layer.

* * * * *